United States Patent [19]

Kletzmaier et al.

[11] Patent Number: 4,563,886

[45] Date of Patent: Jan. 14, 1986

[54] LOCKING ARRANGEMENT FOR SECURING DOORS

[75] Inventors: Karl Kletzmaier, Ottensheim; Gunther Krippner, Linz, both of Austria

[73] Assignee: ELEKTRONIKBAU Krippner & Kletzmaier Gesellschaft m.b.H. & Co., Linz, Austria

[21] Appl. No.: 498,309

[22] Filed: May 26, 1983

[30] Foreign Application Priority Data

Jun. 7, 1982 [AT] Austria ..... 2208/82

[51] Int. Cl.[4] ..... E05B 47/00

[52] U.S. Cl. ..... 70/118; 70/277; 70/DIG. 49

[58] Field of Search ..... 70/114, 118, 120, 277, 70/465, DIG. 49; 292/144, 341.16, 181, 33, 254, 5, 53, DIG. 44

[56] References Cited

U.S. PATENT DOCUMENTS

| | | | |
|---|---|---|---|
| 2,188,034 | 1/1940 | Darby | 292/33 X |
| 2,786,701 | 3/1957 | Povlich | 292/341.16 X |
| 2,989,859 | 6/1961 | Eads | 292/5 X |
| 3,872,696 | 3/1975 | Geringer | 292/254 X |
| 3,919,869 | 11/1975 | Fromm | 292/341.16 X |
| 4,355,830 | 10/1982 | Rau, III | 292/254 X |

FOREIGN PATENT DOCUMENTS 1907154 9/1970 Fed. Rep. of Germany .

*Primary Examiner*—Robert L. Wolfe
*Attorney, Agent, or Firm*—Kurt Kelman

[57] ABSTRACT

A locking arrangement for securing doors (2) or the like with two bolts (5, 6) displaceable relative to the door (2) to be closed and two locking devices (7, 8) associated therewith are described. One of the two locking devices (7, 8) has a locking mechanism (9) lockable with a key (10) and the other one is associated with a remote-controllable unlocking drive (14). A positioning device (16) is furthermore associated with lock bolt (5) lockable by the locking mechanism (9), which is actuated when lock bolt (5) is open. The actuation of the remote-controllable unlocking drive (14) is released when lock bolt (5) is open. Safety bolt (6) is associated with the unlocking drive (14). A drive device (17) is associated with the safety bolt (6) and is effective in the opening direction. It cooperates with the lock bolt (5) and is movable with the same in a starting position provided for the displacement of the safety bolt (6).

11 Claims, 15 Drawing Figures

Figure 1:
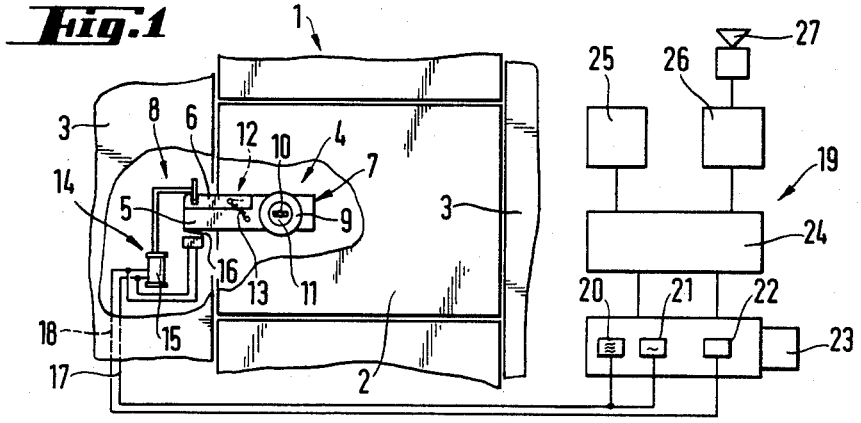

Fig.8
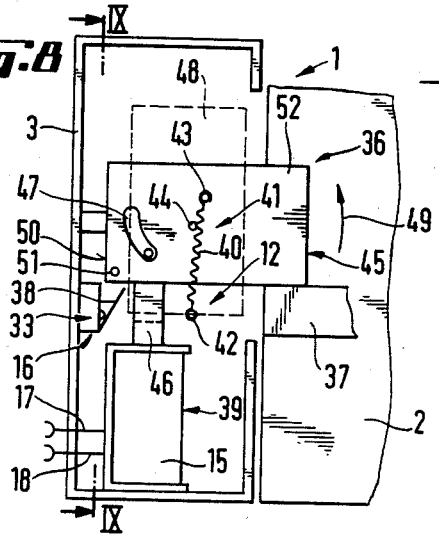
Fig.9
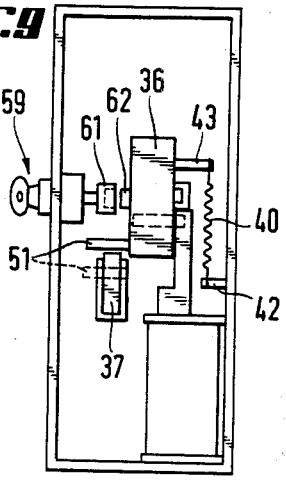
Fig.10
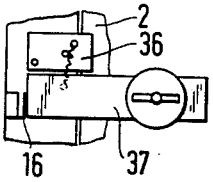
Fig.11
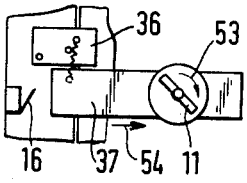
Fig.12
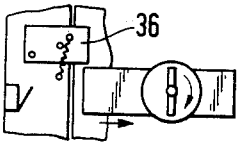
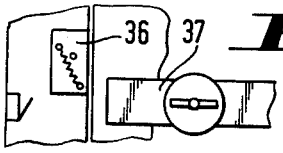
Fig.13
Fig.14
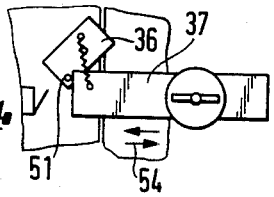
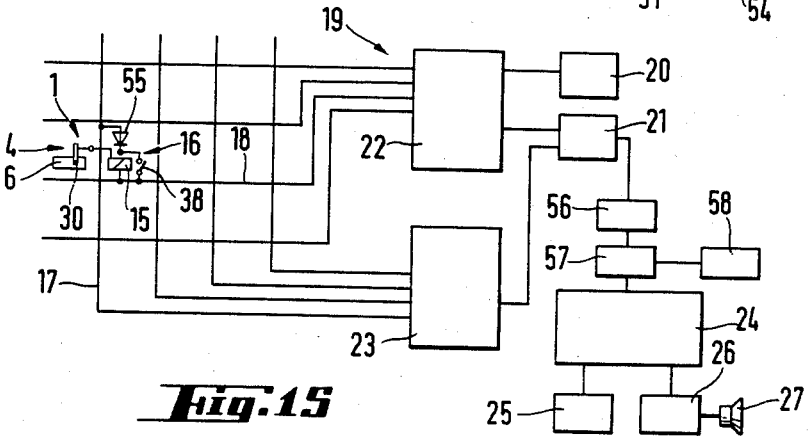
Fig.15

LOCKING ARRANGEMENT FOR SECURING DOORS

Locking arrangements having two bolts mounted for displacement relative to the door to be closed and locking devices associated therewith are known for securing doors, especially in small safe installations. One of the two bolts is to be manually unbolted by a locking mechanism which may be locked with a key. The other bolt may be released fully automatically by a remote-controllable unlocking drive. A relatively large force is required for the displacement of the remote-controllable bolt. Therefore, each lock is equipped with control lines for monitoring the lock and, additionally, with constant-current conductors for actuation of the drive device for the remote-controllable locking bolt.

The present invention addresses the object of providing a locking arrangement of the above-described type, in which the remote-controllable opening of the safety bolt requires only a small power so that the electrical installation of such locking arrangements is simplified. Furthermore, the use of standard locks should be made possible in the locking arrangement of the invention.

This object of the invention is accomplished with a positioning means associated with the locking bolt lockable with the locking mechanism and actuated when the locking bolt is open to release the remote-controllable unlocking drive, and a drive device effective in an opening direction and associated with the safety bolt associated with the unlocking drive, the drive device cooperating with the lock bolt and being adjustable therewith into a starting position for the displacement of the safety bolt. The advantage of this unexpectedly simple solution resides in the fact that the force from the actuation of the manually operable lock bolt is stored for the displacement of the safety bolt. Because the manually produced displacement force for the lock bolt is utilized for displacing the safety bolt into the open or closed position, the power requirement to be produced by the electrical energy is small. At the same time, additional securing of the door by a further safety bolt is possible when standard locks are used by retrofitting very few parts. A fully electronic securing of the door against unauthorized opening is possible in connection with a control device connected to a data bank. Another advantage of the locking arrangement resides in the fact that, by arranging a positioning means for the lock bolt, the safety bolt to be opened by the remote-controllable locking device is exactly defined. In this way, faulty operations are avoided in such locking arrangements for securing doors.

According to another, very material feature of the invention, the safety bolt is displaceably mounted in a guide path extending in the opening direction and which may be arranged on the lock bolt, and the locking device associated with the safety bolt has an unlocking drive constituted by an electromagnet and a latch engaging the safety bolt and displaceable by the electromagnet into a release position remote from the safety bolt. This enables the locking arrangement of the invention to be of a compact construction, guidance of the safety bolt on the lock bolt reducing the cost for installing the safety bolt. Since the safety bolt must be released only by the latch for opening, the energy requirement for opening of the locking device is small. Therefore, the current for energizing the electromagnet operating the latch may be transmitted by the existing control and monitoring lines.

According to the invention, the drive device for the safety bolt may be constituted by a tension device, for example a coil spring, arranged between the lock and safety bolt. It is of advantage in this embodiment that the force required for opening the safety bolt by also be applied after an actuation or opening of the lock bolt. By imparting a pre-tension to the tension device or the coil spring constituting the same, the force for displacing the safety bolt is also available after actuation of the lock bolt when the latch is released.

According to a further embodiment of the invention, the guide path for the safety bolt is preferably arranged in the doorframe and the drive device is constituted by a tension device, i.e. a coil spring, arranged between the safety bolt and the doorframe. This enables already existing locking arrangements to be simply rebuilt into locking arrangements according to the invention since nothing need be changed on the lock bolts and the installations in the door.

An embodiment of the invention is advantageous in which the safety bolt is pivotal about an axis and the drive device has a tension device, for example a coil spring, which may be moved by the unlocking drive, for example an electromagnet, from a rest position between the axis and an end face of the safety bolt to an opening position between the axis and the opposite end face of the safety device. This solution according to the invention is also characterized by enabling simple retrofitting of existing locking arrangements and, furthermore, actuation of the additional bolt independently of whether the lock bolt to be operated has already been manually moved into its open position or not. The force for opening the lock bolt is in this case already stored by the preceding closing of the manually operable lock bolt.

According to the invention, it is also possible for the safety bolt, the associated drive device as well as the unlocking drive and the positioning means associated with the lock bolt to be arranged in the doorframe.

An embodiment in which the positioning means is connected parallel to the unlocking drive, for example the electromagnet, and has a circuit breaker having, for example an opening contact, actuated when the lock bolt is open is also within the scope of the invention. This embodiment is characterized by very low installation costs since only two lines for monitoring the position of the positioning means as well as for actuating the unlocking drive are required. It is also advantageous if the positioning means and the unlocking drive are connected to a high-frequency power supply installation as well as to a low-frequency power supply installation since different data may be transmitted in a simple manner over the same transmission system. In this way, the positioning of the positioning means as well as the actuation of the electromagnet may be effected without mutual interference.

Finally, still another, very advantageous embodiment of the invention provides that the control device for the locking arrangement has a line-column matrix and that the positioning means are connected to the high-frequency power supply installation by a line control unit and a column control unit, and that a code member is actuated when the opening contact of the positioning means is actuated, the code member connecting the unlocking drive to the low-frequency power supply installation by the line control unit and the column control unit, a locking member being preferably associated with the code member and being integrated with an encoding unit and an alarm emitting installation, the alarm emitting installation being actuated when the positioning means is actuated without the presence of a release signal emitted by the encoding unit. A very small installation cost is involved in a plurality of locking arrangements according to the invention, for example in small safe installations, with such a control and monitoring apparatus in conjunction with the line-column matrix. It is advantageous that the existing structural parts may also be used for monitoring the doors secured by the locking arrangements of the present invention against unauthorized opening. In this manner, a favorable combination between the cost of the locking arrangement and the attainable degree of safety is achieved.

The invention also provides an emergency opening device associated with the safety bolt or its drive device, preferably comprising an actuating device engageable by a lock with the safety bolt or its drive device. This makes it possible to actuate the safety bolt manually in conjunction with a further key when the drive device or the unlocking device malfunctions.

Figure 2:
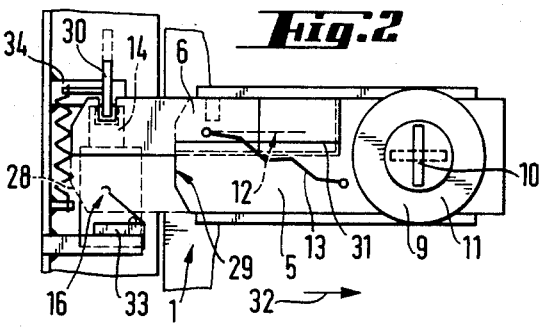
Figure 3:
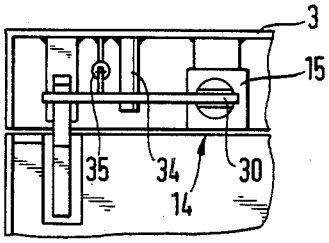

For a better understanding, the invention will be more fully explained hereinafter in conjunction with the embodiments illustrated in the drawings showing in FIG. 1 a side elevational view of a locking arrangement according to the invention, built into a small safe, with the associated control arrangement;

FIG. 2 a side elevational view of the locking arrangement of FIG. 1, on an enlarged scale;

FIG. 3 a top view of the locking arrangement according to FIGS. 1 and 2;

FIGS. 4–7, in side elevational views, different positions of the lock and safety bolts of the locking arrangement of the invention according to FIGS. 1–3;

FIG. 8 a side elevational view of another embodiment of the locking arrangement of the invention;

FIG. 9 an end view of the locking arrangement of FIG. 8;

FIGS. 10–14 different positions of the lock and safety bolts of the locking arrangement of FIGS. 8 and 9;

FIG. 15 a circuit diagram of a control arrangement associated with a locking arrangement of the invention.

FIG. 1 illustrates a door 2 of a small safe 1 and the associated doorframe 3. A locking arrangement 4 is arranged between door 2 and doorframe 3. This locking arrangement 4 comprises a lock bolt 5 as well as a safety bolt 6. Locking device 7 is associated with lock bolt 5 and locking device 8 is associated with safety bolt 6. Locking device 7 comprises a manually operated locking mechanism 9 having a handle 11 which may be locked with a key 10. Drive device 12, which may be constituted, for example, by a coil spring 13, is arranged between lock bolt 5 and safety bolt 6.

An unlocking drive 14, namely an electromagnet 15, forming part of locking device 8 for safety bolt 6 is illustrated in doorframe 3. A positioning means is associated with lock bolt 5 in doorframe 3. Electromagnet 15 as well as positioning means 16 are connected by two conductors 17, 18 with a control arrangement 19. This control arrangement 19 is equipped with a high-frequency power supply installation 20, a low-frequency power supply installation 21, a line control unit 22, a column control unit 23, a programming circuit 24, for example a computer, an energy supply device 25, an alarm emitter installation 26 as well as a siren 27 associated with the alarm emitter installation.

Locking arrangement 1 is illustrated in FIG. 2, lock bolt 5 being open. This is effected by turning key 10 90° to release handle 11, and bolt 5 is moved from rest position 28 shown in broken lines to open position 29 shown in full lines by turning handle 11. Safety bolt 6 is in the closed position since it is retained by latch 30 connected to unlocking drive 14. By moving lock bolt 5 into open position 29, drive device 12—coil spring 13—is pre-tensioned to move safety bolt 6 after its release along a guide path 31 arranged on lock bolt 5 in an opening direction—arrow 32—into the open position shown in broken lines. When lock bolt 5 is retracted with handle 11, positioning means 16 is also released and a circuit breaker 33 is opened.

The mounting of latch 30 is illustrated in FIG. 3. Latch 30 is rotatably mounted—substantially in the center of its longitudinal extension—on an axle 34 which is affixed to doorframe 3 and is coupled with electromagnet 15 of locking drive 14 at its end region remote from safety bolt 6. Latch 30 is pre-tensioned by a tension spring 35 in the direction of safety bolt 6 in its position wherein it holds safety bolt 6 fixed. The latch is pivoted upwardly by electromagnet 15 against the bias of tension spring 35 to unlock safety bolt 6.

Figure 4:
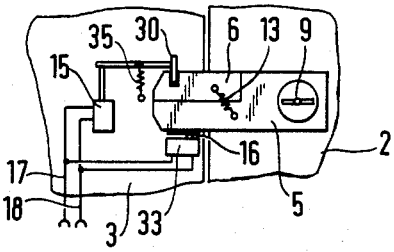
Figure 5:
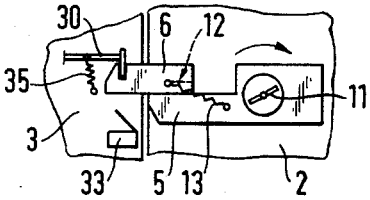

The different positions of safety and lock bolts 6, 7 and drive device 12 between the two bolts as well as of positioning means 16 and latch 30 are illustrated in FIGS. 4–7. The locking arrangement is shown in closed condition in FIG. 4. Locking mechanism 9 is closed and is locked by the key. Positioning means 16 is actuated by lock bolt 5. Circuit breaker 33 is closed. Conductors 17 and 18 are connected. The high-frequency supplied by control arrangement 19 to conductors 17 and 18 does not energize the coil of electromagnet 15 but is directly returned through the closed contact of circuit breaker 33 to the control arrangement. In case an attempt is made forcibly to open door 2, positioning means 16 is released at the opening of lock bolt 5 and circuit breaker 33 is opened. Upon opening of the circuit breaker, the transmission of the high-frequency currents or pulses is interrupted and control arrangement 19 triggers an alarm according to the set program. However, if an opening of door 2 is programmed in control arrangement 19 by programming circuit 24, locking mechanism 9 may be unlocked with the key and lock bolt 5 may be displaced into its open position by turning handle 11, as shown in FIG. 5. This displacement of lock bolt 5 causes drive device 12, namely coil spring 13, to be pre-tensioned since safety bolt 6 is still retained by latch 30. Opening that lock bolt 5 in door 2 has been opened, the by-pass circuit of electromagnet 15 is interrupted and a low-frequency voltage may now be transmitted from control arrangement 19 through the same conductors 17, 18 to excite electromagnet 15 for a short time interval. The force of electromagnet 15 must be sufficient merely to overcome the bias of tension spring 35 to move latch 30 out of the cross sectional range of safety bolt 6. The force required for displacing safety bolt 6 into its open position after latch 30 has been raised is provided by already pre-tensioned coil spring 13. For this reason, only an electromagnet of low capacity is required and conducting wires of small cross section are useful for energizing electromagnet 15.

Figure 6:
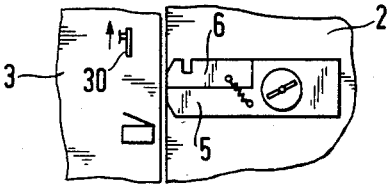

FIG. 6 shows the position of lock and safety bolts 5 and 6, in which door 2 may be opened.

Figure 7:
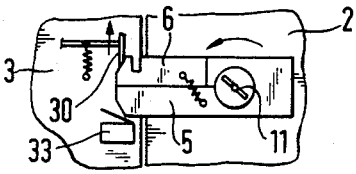

FIG. 7 shows how lock and safety bolts 5 and 6 are simultaneously moved in the direction of doorframe 3 when the locking arrangement is closed by handle 11. Circuit breaker 33 is closed by lock bolt 5. The shape of the end face of safety bolt 6 assures that, at closing, latch 30 is upwardly pressed against the bias of tension spring 35 and engages safety bolt 6. In this manner, the condition shown in FIG. 4 is restored.

FIGS. 8 and 9 illustrate another embodiment of locking arrangement 1. In the locking arrangement shown in FIG. 8, a safety bolt 36 is arranged in doorframe 3 of a small safe. A lock bolt 37 is arranged in door 2. Positioning means 16 is associated with lock bolt 37 in doorframe 3. An opening contact 38 of circuit breaker 33 constituting positioning means 16 is open since lock bolt 37 has already been opened and has been retracted into door 2. Door 2 is still blocked against opening by safety bolt 36. Unlocking drive 39 is arranged for opening safety bolt 36 and comprises electromagnet 15 as well as pulling device 41 constituted by a coil spring 40 and serving as drive device for safety bolt 36. This coil spring 40 is mounted with its end 42 in doorframe 3 and with its end 43 on safety bolt 36. In the closed position of safety bolt 36, coil spring 40 is located between an axle 44 about which safety bolt 36 is pivotal and an end face 45 thereof. A pushrod 46 of electromagnet 15 is guided in a bracket path 47 centered relative to axle 44. When safety bolt 36 is opened, electromagnet 15 is energized through conductors 17, 18 and attracts pushrod 46. Safety bolt 36 is pivoted into open position 48 shown in broken lines in the direction of arrow 49. The force of electromagnet 15 may be held low since, even after a small pivoting angle, end 43 of pulling device 41 is located between axle 44 and an end face 50 very close to bracket path 47 and supports the opening movement of safety bolt 36.

FIG. 9 shows that safety bolt 36 has an entrainment pin 51 which is pivoted into the displacement path of lock bolt 37 when safety bolt 36 is opened—as indicated in broken lines. Safety bolt 36 is brought by entrainment pin 51 into rest position 52 shown in full lines by the manual force generated at the closing of lock bolt 37 and coil spring 40 is again pre-tensioned for a following opening movement.

The different positions of lock and safety bolts 36, 37 as well as positioning means 16 are shown in FIGS. 10–14 for a better understanding of the operation of the locking arrangement of the invention. In FIG. 10, the locking arrangement is closed and door 2 is secured by lock bolt 37 as well as safety bolt 36. After the lock is opened, lock bolt 37 may be moved in the opening direction—arrow 54—by turning handle 11 in the direction of arrow 53, FIGS. 11, 12. This releases opening contact 38 of positioning means 16 and informs the control arrangement that safety bolt 36 may now be opened. The opening of safety bolt 36 is then effected in the manner described in connection with FIGS. 8 and 9. The position of lock and safety bolts 36, 37 in the open position is shown in FIG. 13.

FIG. 14 shows how safety bolt 36 may be returned by entrainment pin 51 back into its closed position shown in FIG. 10 by the manual displacement of lock bolt 37 when locking arrangement 1 is closed in a direction opposite to the opening direction—arrow 54.

FIG. 15 illustrates control arrangement 19 associated with the locking arrangements in greater detail. To hold down the installation costs in securing a plurality of doors, as is normally the case in small safe installations, a so-called line-column matrix is used for controlling positioning means 16 of the individual doors. To ascertain the position of lock and safety bolts 5, 6 or 36, 37, a high-frequency current pulse or a pulse package is emitted which does not excite electromagnet 15. This testing pulse may be emitted for each locking arrangement or for a whole column together.

For this purpose, control arrangement 19 is equipped with line control unit 22 and column control unit 23. The individual lines and columns of the control system may be connected to high-frequency power supply 20 or low-frequency power supply 21 by line and column control units 22, 23. Line and column control units 22, 23 are controlled by programming circuit 24 and are connected to an energy supply unit 25. For the case of an unauthorized opening of a locking arrangement or a door of such a safe installation, an alarm emitting installation 26 with a siren 27 is associated with the programming circuit. Obviously, any type of alarm emitter, for example a light signal installation or a fully automatic break-in indicating installation with information transmission to the police, may be connected to alarm emitting installation 26.

A locking arrangement 4 is arranged at each intersection between a line and a column of the line-and-column matrix. For a better understanding, FIG. 15 refers back to locking arrangement 4 described in connection with FIGS. 1 and 2. This locking arrangement 4 is located in the range in intersection between conductor 18 embodying the line and conductor 17 embodying the column. Positioning means 16 is connected between these conductors 17 and 18. A diode 55 is additionally arranged between positioning means 16 and conductor 17 to eliminate actuation of additional locking arrangements. Electromagnet 15 is connected parallel to positioning means 16 and is connected to latch 30.

Control arrangement 19 operates so that a common test pulse is triggered by programming circuit 24 for each lock or for the locks arranged in a column, for example along conductor 17. This is effected by transmitting individual current pulses or high-frequency current pulse packages from high-frequency power supply installation 20 through column control units 23 to individual locking arrangements 1. This high-frequency current pulse does not pass through electromagnet 15. It also does not excite the magnet. If circuit breaker 33 of positioning means 16 is closed, these pulses are returned unhindered to control arrangement 19 through the circuit breaker. A continuous passage of these pulses or pulse packages can be detected in programming circuit 24. The condition is recognized as properly closed. When it is desired to open locking arrangement 1, opening of door 2 is made possible by the program stored in circuit 24. Opening contact 38 of positioning means 16 is opened by opening the lock with the aid of the key. The interruption of the transmission of the high-frequency current pulses or pulse packages signals to programming circuit 24 that safety bolt 6 associated with the locking arrangement is to be opened. Programming circuit 24 connects low-frequency power supply installation 21 to conductors 17 and 18 because of the change of the condition of positioning means 16. Since opening contact 38 of positioning means 16 is open, electromagnet 15 is energized and opens latch 30. Safety bolt 6 is pulled into its open position.

After locking arrangement 1 is closed, programming circuit 24 again recognizes the closed condition of locking arrangement 1 and the locking arrangement is again placed into the normal surveillance by the high-frequency current pulses.

To obtain additional security, the programming circuit may be so programmed that a warning signal is emitted after a certain open time to prevent doors of the safe installation from remaining open inadvertently.

However, if locking arrangement 1 is opened without authorization, i.e. no opening release is indicated in the programming circuit, the alarm is triggered in the following manner:

At an unauthorized opening of locking arrangement 1, positioning means 16 is released by the retraction of lock bolt 5 and the high-frequency current pulses or pulse packages are interrupted. Normally low-frequency power supply 21 would now be energized through code member 56 by programming circuit 24 to open safety bolt 6. However, locking member 57 connected to coding unit 58 is arranged between programming circuit 24 and code member 56. If no opening release for this locking arrangement is given to encoding unit 58, in which positioning means 16 is opened, the control pulse from programming circuit 24 cannot be transmitted to low-frequency power supply 21. This interruption is recognized by programming circuit 24 and accordingly actuated alarm emitting installation 26 which informs the security forces about the unauthorized opening of a locking arrangement either by siren 27 or a fully automatic information emitter.

To enable safety bolt 6 to be opened even in case of a malfunctioning of programming circuit 24 or drive device 12, or a defect in the locking device associated with safety bolt 6, 36, an emergency opening device 59 may be provided, as schematically indicated in FIG. 9. In the illustrated embodiment, this comprises a lock 60 as well as an actuating device 61. In case of an emergency, the actuating device is unlocked with the key through lock 60 and is pressed in the direction of safety bolt 36 until actuating device 61 engages rectangular portion 62 on safety bolt 36 in the range of axle 44 with its rectangular bore. Safety bolt 36 may then be pivoted into the open position by turning actuating device 61.

In this manner, it is assured that the door locked by the locking arrangement of this invention may be opened with simple mechanical means with the use of an additional lock even when the control arrangement malfunctions.

We claim:

1. A locking arrangement for securing a door having a door frame, which comprises (a) a lock bolt and a safety bolt mounted for displacement relative to the door, (b) a first locking device associated with the lock bolt and having (1) a key-operated locking mechanism for locking the lock bolt, (c) a second locking device associated with the safety bolt and having (1) a latch element for engaging the safety bolt, (2) a remote-controllable unlocking drive for the latch element and (3) a drive device effective in an opening direction and cooperating with the safety bolt for adjustment therewith into a locking position and into a starting position allowing for the displacement of the safety bolt, respectively, (d) a positioning means associated with the lock bolt, and (e) a circuit control arrangement for the remote-controllable unlocking drive, (1) the lock bolt positioning means assuming a circuit switching position when the lock bolt is open, wherein the remote-controllable unlocking drive for the latch element is actuated by the control arrangement to release the latch element.

2. Locking arrangement according to claim 1, wherein the drive device for the safety bolt is constituted by a tension device arranged between the lock and safety bolts.

3. Locking arrangement according to claim 1, wherein the positioning means is connected parallel to the unlocking drive, and comprising a circuit breaker having an opening contact actuated when the lock bolt is open.

4. Locking arrangement according to claim 3, wherein the positioning means and the unlocking drive are connected to a high-frequency power supply installation as well as a low-frequency power supply installation.

5. Locking arrangement according to claim 1, comprising a control arrangement having a line-column matrix, the positioning means being connected to the high-frequency power supply installation by a line control unit and a column control unit, and a code member (56) actuated when the opening contact of the positioning means is actuated, the code member connecting the unlocking drive to the low-frequency power supply installation by the line control unit and the column control unit.

6. Locking arrangement according to claim 1, further comprising an emergency opening device associated with the safety bolt and comprising an actuating device engageable by a lock with the safety bolt.

7. Locking arrangement according to claim 5, further comprising a locking member associated with the code member, an encoding unit whereon the code member is integrated, and an alarm emitting installation actuated when the positioning means is actuated in the absence of a release signal emitted by the encoding unit.

8. The locking arrangement of claim 6, wherein the safety bolt is displaceably mounted in a guide path extending in the opening direction and the unlocking drive is constituted by an electromagnet extending perpendicularly to the guide path.

9. The locking arrangement of claim 8, wherein the guide path for the safety bolt is arranged on the lock bolt.

10. The locking arrangement of claim 1, wherein the latch element is a pushrod and the unlocking drive is an electromagnet operating the pushrod, the safety bolt is pivotal about an axis extending perpendicularly to the pushrod, the pushrod is guided in a guide path arranged in the safety bolt and centered about the axis, and the drive device comprises a tensioned pulling element attached to the safety bolt and arranged to extend between the axis and an end face of the safety bolt remote from the guide path when the safety bolt is in an opening position.

11. The locking arrangement of claim 10, wherein the lock bolt positioning means, the pushrod, the tensioned pulling element and the unlocking drive are arranged in the door frame.

* * * * *